US008629813B2

(12) United States Patent
Milosavljevic

(10) Patent No.: US 8,629,813 B2
(45) Date of Patent: Jan. 14, 2014

(54) ADJUSTABLE MULTI-BAND ANTENNA AND METHODS

(75) Inventor: Zlatoljub Milosavljevic, Espoo (FI)

(73) Assignee: Pusle Finland Oy, Kempele (FI)

( * ) Notice: Subject to any disclaimer, the term of this patent is extended or adjusted under 35 U.S.C. 154(b) by 494 days.

(21) Appl. No.: 12/673,966

(22) PCT Filed: Aug. 20, 2008

(86) PCT No.: PCT/FI2008/050469

§ 371 (c)(1),
(2), (4) Date: Jan. 7, 2011

(87) PCT Pub. No.: WO2009/027579

PCT Pub. Date: Mar. 5, 2009

(65) Prior Publication Data

US 2011/0102290 A1 May 5, 2011

(30) Foreign Application Priority Data

Aug. 30, 2007 (FI) ..... 20075597

(51) Int. Cl.
*H01Q 1/50* (2006.01)

(52) U.S. Cl.
USPC ..... 343/852; 343/850

(58) Field of Classification Search
USPC ..... 343/850, 852, 745, 746, 749
See application file for complete search history.

(56) References Cited

U.S. PATENT DOCUMENTS

| | | | |
|---|---|---|---|
| 2,745,102 | A | 5/1956 | Norgorden |
| 3,938,161 | A | 2/1976 | Sanford |
| 4,004,228 | A | 1/1977 | Mullett |
| 4,028,652 | A | 6/1977 | Wakino et al. |
| 4,031,468 | A | 6/1977 | Ziebell et al. |
| 4,054,874 | A | 10/1977 | Oltman |
| 4,069,483 | A | 1/1978 | Kaloi |
| 4,123,756 | A | 10/1978 | Nagata et al. |
| 4,123,758 | A | 10/1978 | Shibano et al. |

(Continued)

FOREIGN PATENT DOCUMENTS

| | | |
|---|---|---|
| CN | 1316797 | 10/2007 |
| DE | 10015583 | 11/2000 |

(Continued)

OTHER PUBLICATIONS

"An Adaptive Microstrip Patch Antenna for Use in Portable Transceivers", Rostbakken et al., Vehicular Technology Conference, 1996, Mobile Technology for the Human Race, pp. 339-343.

(Continued)

*Primary Examiner* — Hoang V Nguyen
(74) *Attorney, Agent, or Firm* — Gazdzinski & Associates, PC

(57) ABSTRACT

An adjustable multi-band planar antenna especially applicable in mobile terminals. In one embodiment, the feed of the antenna is connected by a multiple-way switch to at least two alternative points of the radiator element. When the feed point is changed, the resonance frequencies and thus the operating bands of the antenna change. In addition to varying the basic dimensions of the antenna, the distance between one feed point to another and a possible short-circuit point in the radiator, the value of the series capacitance produced by a reactive circuit that is formed between the feed point and switch, and the distance between the ground plane and the radiator, are parameters that may affect the antenna design.

26 Claims, 4 Drawing Sheets

(56) References Cited

Figure 1:
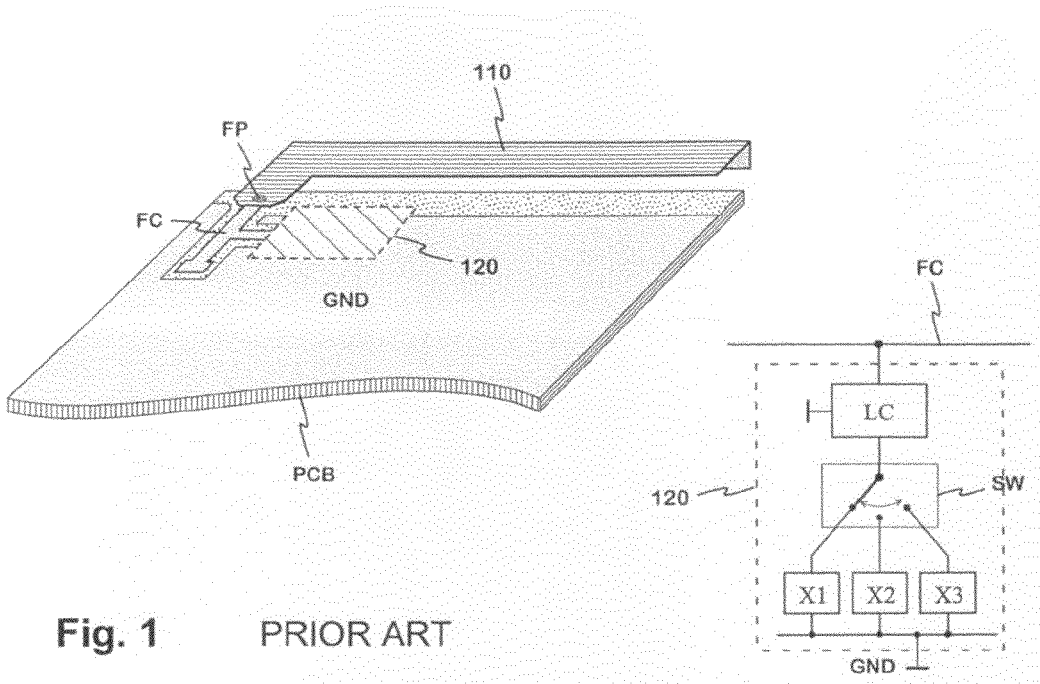
Fig. 1 PRIOR ART

U.S. PATENT DOCUMENTS 4,131,893 A 12/1978 Munson et al.
4,201,960 A 5/1980 Skutta et al.
4,255,729 A 3/1981 Fukasawa et al.
4,313,121 A 1/1982 Campbell et al.
4,356,492 A 10/1982 Kaloi
4,370,657 A 1/1983 Kaloi
4,423,396 A 12/1983 Makimoto et al.
4,431,977 A 2/1984 Sokola et al.
4,546,357 A 10/1985 Laughon et al.
4,559,508 A 12/1985 Nishikawa et al.
4,625,212 A 11/1986 Oda et al.
4,652,889 A 3/1987 Bizouard et al.
4,661,992 A 4/1987 Garay et al.
4,692,726 A 9/1987 Green et al.
4,703,291 A 10/1987 Nishikawa et al.
4,706,050 A 11/1987 Andrews
4,716,391 A 12/1987 Moutrie et al.
4,740,765 A 4/1988 Ishikawa et al.
4,742,562 A 5/1988 Kommrusch
4,761,624 A 8/1988 Igarashi et al.
4,800,348 A 1/1989 Rosar et al.
4,800,392 A 1/1989 Garay et al.
4,821,006 A 4/1989 Ishikawa et al.
4,823,098 A 4/1989 DeMuro et al.
4,827,266 A 5/1989 Sato et al.
4,829,274 A 5/1989 Green et al.
4,862,181 A 8/1989 Ponce de Leon et al.
4,879,533 A 11/1989 De Muro et al.
4,896,124 A 1/1990 Schwent
4,954,796 A 9/1990 Green et al.
4,965,537 A 10/1990 Kommrusch
4,977,383 A 12/1990 Niiranen
4,980,694 A 12/1990 Hines
5,017,932 A 5/1991 Ushiyama et al.
5,047,739 A 9/1991 Kuokkanen
5,053,786 A 10/1991 Silverman et al.
5,097,236 A 3/1992 Wakino et al.
5,103,197 A 4/1992 Turunen
5,109,536 A 4/1992 Kommrusch
5,155,493 A 10/1992 Thursby et al.
5,157,363 A 10/1992 Puurunen
5,159,303 A 10/1992 Flink
5,166,697 A 11/1992 Viladevall et al.
5,170,173 A 12/1992 Krenz et al.
5,203,021 A 4/1993 Repplinger et al.
5,210,510 A 5/1993 Karsikas
5,210,542 A 5/1993 Pett et al.
5,220,335 A 6/1993 Huang
5,229,777 A 7/1993 Doyle
5,239,279 A 8/1993 Turunen
5,278,528 A 1/1994 Turunen
5,281,326 A 1/1994 Galla
5,298,873 A 3/1994 Ala-Kojola
5,302,924 A 4/1994 Jantunen
5,304,968 A 4/1994 Ohtonen
5,307,036 A 4/1994 Turunen
5,319,328 A 6/1994 Turunen
5,349,315 A 9/1994 Ala-Kojola
5,349,700 A 9/1994 Parker
5,351,023 A 9/1994 Niiranen
5,354,463 A 10/1994 Turunen et al.
5,355,142 A 10/1994 Marshall et al.
5,357,262 A 10/1994 Blaese
5,363,114 A 11/1994 Shoemaker
5,369,782 A 11/1994 Kawano et al.
5,382,959 A 1/1995 Pett et al.
5,386,214 A 1/1995 Sugawara
5,387,886 A 2/1995 Takalo
5,394,162 A 2/1995 Korovesis et al.
RE34,898 E 4/1995 Turunen
5,408,206 A 4/1995 Turunen
5,418,508 A 5/1995 Puurunen
5,432,489 A 7/1995 Yrjola
5,438,697 A 8/1995 Fowler et al.
5,440,315 A 8/1995 Wright et al.
5,442,366 A 8/1995 Sanford
5,444,453 A 8/1995 Lalezari
5,467,065 A 11/1995 Turunen
5,473,295 A 12/1995 Turunen
5,506,554 A 4/1996 Ala-Kojola
5,508,668 A 4/1996 Prokkola
5,517,683 A 5/1996 Collett et al.
5,521,561 A 5/1996 Yrjola
5,532,703 A 7/1996 Stephens et al.
5,541,560 A 7/1996 Turunen
5,541,617 A 7/1996 Connolly et al.
5,543,764 A 8/1996 Turunen
5,550,519 A 8/1996 Korpela
5,557,287 A 9/1996 Pottala et al.
5,557,292 A 9/1996 Nygren et al.
5,570,071 A 10/1996 Ervasti
5,585,771 A 12/1996 Ervasti
5,585,810 A 12/1996 Tsuru et al.
5,589,844 A 12/1996 Belcher et al.
5,594,395 A 1/1997 Niiranen
5,604,471 A 2/1997 Rattila
5,627,502 A 5/1997 Ervasti
5,649,316 A 7/1997 Prudhomme et al.
5,668,561 A 9/1997 Perrotta et al.
5,675,301 A 10/1997 Nappa et al.
5,689,221 A 11/1997 Niiranen
5,694,135 A 12/1997 Dikun et al.
5,703,600 A 12/1997 Burrell et al.
5,709,823 A 1/1998 Hayes et al.
5,711,014 A 1/1998 Crowley et al.
5,717,368 A 2/1998 Niiranen
5,731,749 A 3/1998 Yrjola
5,734,305 A 3/1998 Ervasti
5,734,350 A 3/1998 Deming et al.
5,734,351 A 3/1998 Ojantakanen
5,739,735 A 4/1998 Pyykko
5,742,259 A 4/1998 Annamaa
5,757,327 A 5/1998 Yajima et al.
5,764,190 A 6/1998 Murch et al.
5,767,809 A 6/1998 Chuang et al.
5,768,217 A 6/1998 Sonoda et al.
5,777,581 A 7/1998 Lilly et al.
5,777,585 A 7/1998 Tsuda et al.
5,793,269 A 8/1998 Ervasti
5,812,094 A 9/1998 Maldonado
5,815,048 A 9/1998 Ala-Kojola
5,822,705 A 10/1998 Lehtola
5,852,421 A 12/1998 Maldonado
5,861,854 A 1/1999 Kawahata et al.
5,874,926 A 2/1999 Tsuru et al.
5,880,697 A 3/1999 McCarrick et al.
5,886,668 A 3/1999 Pedersen et al.
5,892,490 A 4/1999 Asakura et al.
5,903,820 A 5/1999 Hagstrom
5,905,475 A 5/1999 Annamaa
5,920,290 A 7/1999 McDonough et al.
5,926,139 A 7/1999 Korisch
5,929,813 A 7/1999 Eggleston
5,936,583 A 8/1999 Sekine
5,943,016 A 8/1999 Snyder, Jr. et al.
5,952,975 A 9/1999 Pedersen et al.
5,959,583 A 9/1999 Funk
5,963,180 A 10/1999 Leisten
5,966,097 A 10/1999 Fukasawa et al.
5,970,393 A 10/1999 Khorrami et al.
5,977,710 A 11/1999 Kuramoto et al.
5,986,606 A 11/1999 Kossiavas et al.
5,986,608 A 11/1999 Korisch et al.
5,990,848 A 11/1999 Annamaa
5,999,132 A 12/1999 Kitchener et al.
6,005,529 A 12/1999 Hutchinson
6,006,419 A 12/1999 Vandendolder et al.
6,008,764 A 12/1999 Ollikainen
6,009,311 A 12/1999 Killion et al.
6,014,106 A 1/2000 Annamaa
6,016,130 A 1/2000 Annamaa
6,023,608 A 2/2000 Yrjola
6,031,496 A 2/2000 Kuittinen et al.
6,034,637 A 3/2000 McCoy et al.

(56) References Cited

U.S. PATENT DOCUMENTS 6,037,848 A 3/2000 Alila
6,043,780 A 3/2000 Funk et al.
6,072,434 A 6/2000 Papatheodorou
6,078,231 A 6/2000 Pelkonen
6,091,363 A 7/2000 Komatsu et al.
6,097,345 A 8/2000 Walton
6,100,849 A 8/2000 Tsubaki et al.
6,112,106 A 8/2000 Crowley et al.
6,133,879 A 10/2000 Grangeat et al.
6,134,421 A 10/2000 Lee et al.
6,140,973 A 10/2000 Annamaa
6,147,650 A 11/2000 Kawahata et al.
6,157,819 A 12/2000 Vuokko
6,177,908 B1 1/2001 Kawahata
6,185,434 B1 2/2001 Hagstrom
6,190,942 B1 2/2001 Wilm et al.
6,195,049 B1 2/2001 Kim et al.
6,204,826 B1 3/2001 Rutkowski et al.
6,215,376 B1 4/2001 Hagstrom et al.
6,246,368 B1 6/2001 Deming et al.
6,252,552 B1 6/2001 Tarvas et al.
6,252,554 B1 6/2001 Isohatala
6,255,994 B1 7/2001 Saito
6,268,831 B1 7/2001 Sanford
6,295,029 B1 9/2001 Chen et al.
6,297,776 B1 10/2001 Pankinaho
6,304,220 B1 10/2001 Herve et al.
6,308,720 B1 10/2001 Modi
6,316,975 B1 11/2001 O'Toole et al.
6,323,811 B1 11/2001 Tsubaki
6,326,921 B1 12/2001 Egorov et al.
6,337,663 B1 1/2002 Chi-Minh
6,340,954 B1 1/2002 Annamaa et al.
6,342,859 B1 1/2002 Kurz et al.
6,346,914 B1 2/2002 Annamaa
6,348,892 B1 2/2002 Annamaa
6,353,443 B1 3/2002 Ying
6,366,243 B1 4/2002 Isohatala
6,377,827 B1 4/2002 Rydbeck
6,380,905 B1 4/2002 Annamaa
6,396,444 B1 5/2002 Goward
6,404,394 B1 6/2002 Hill
6,417,813 B1 7/2002 Durham
6,423,915 B1 7/2002 Winter
6,429,818 B1 8/2002 Johnson et al.
6,452,551 B1 9/2002 Chen
6,452,558 B1 9/2002 Saitou et al.
6,456,249 B1 9/2002 Johnson et al.
6,459,413 B1 10/2002 Tseng et al.
6,462,716 B1 10/2002 Kushihi
6,469,673 B2 10/2002 Kaiponen
6,473,056 B2 10/2002 Annamaa
6,476,769 B1 11/2002 Lehtola
6,480,155 B1 11/2002 Eggleston
6,501,425 B1 12/2002 Nagumo
6,518,925 B1 2/2003 Annamaa
6,529,168 B2 3/2003 Mikkola
6,535,170 B2 3/2003 Sawamura et al.
6,538,604 B1 3/2003 Isohatala
6,549,167 B1 4/2003 Yoon
6,556,812 B1 4/2003 Pennanen et al.
6,566,944 B1 5/2003 Pehlke
6,580,397 B2 6/2003 Lin
660,449 A1 7/2003 Onaka
6,603,430 B1 8/2003 Hill et al.
6,606,016 B2 8/2003 Takamine et al.
6,611,235 B2 8/2003 Barna et al.
6,614,400 B2 9/2003 Egorov
6,614,405 B1 9/2003 Mikkonen
6,634,564 B2 10/2003 Kuramochi
6,636,181 B2 10/2003 Asano
6,639,564 B2 10/2003 Johnson
6,646,606 B2 11/2003 Mikkola
6,650,295 B2 11/2003 Ollikainen et al.
6,657,593 B2 12/2003 Nagumo et al.
6,657,595 B1 12/2003 Phillips et al.
6,670,926 B2 12/2003 Miyasaka
6,677,903 B2 1/2004 Wang
6,683,573 B2 1/2004 Park
6,693,594 B2 2/2004 Pankinaho et al.
6,717,551 B1 4/2004 Desclos et al.
6,727,857 B2 4/2004 Mikkola
6,734,825 B1 5/2004 Guo et al.
6,734,826 B1 5/2004 Dai et al.
6,738,022 B2 5/2004 Klaavo et al.
6,741,214 B1 5/2004 Kadambi et al.
6,753,813 B2 6/2004 Kushihi
6,759,989 B2 7/2004 Tarvas et al.
6,765,536 B2 7/2004 Phillips et al.
6,774,853 B2 8/2004 Wong et al.
6,781,545 B2 8/2004 Sung
6,801,166 B2 10/2004 Mikkola
6,801,169 B1 10/2004 Chang et al.
6,806,835 B2 10/2004 Iwai
6,819,287 B2 11/2004 Sullivan et al.
6,819,293 B2 11/2004 De Graauw
6,825,818 B2 11/2004 Toncich
6,836,249 B2 12/2004 Kenoun et al.
6,847,329 B2 1/2005 Ikegaya et al.
6,856,293 B2 2/2005 Bordi
6,862,437 B1 3/2005 McNamara
6,862,441 B2 3/2005 Ella
6,873,291 B2 3/2005 Aoyama
6,876,329 B2 4/2005 Milosavljevic
6,882,317 B2 4/2005 Koskiniemi
6,891,507 B2 5/2005 Kushihi et al.
6,897,810 B2 5/2005 Dai et al.
6,900,768 B2 5/2005 Iguchi et al.
6,903,692 B2 6/2005 Kivekas
6,911,945 B2 6/2005 Korva
6,922,171 B2 7/2005 Annamaa
6,925,689 B2 8/2005 Folkmar
6,927,729 B2 8/2005 Legay
6,937,196 B2 8/2005 Korva
6,950,066 B2 9/2005 Hendler et al.
6,950,068 B2 9/2005 Bordi
6,952,144 B2 10/2005 Javor
6,952,187 B2 10/2005 Annamaa
6,958,730 B2 10/2005 Nagumo et al.
6,961,544 B1 11/2005 Hagstrom
6,963,308 B2 11/2005 Korva
6,963,310 B2 11/2005 Horita et al.
6,967,618 B2 11/2005 Ojantakanen
6,975,278 B2 12/2005 Song et al.
6,985,108 B2 1/2006 Mikkola et al.
6,992,543 B2 1/2006 Luetzelschwab et al.
6,995,710 B2 2/2006 Sugimoto et al.
7,023,341 B2 4/2006 Stilp
7,031,744 B2 4/2006 Kuriyama et al.
7,042,403 B2 5/2006 Colburn et al.
7,053,841 B2 5/2006 Ponce De Leon et al.
7,054,671 B2 5/2006 Kaiponen et al.
7,057,560 B2 6/2006 Erkocevic
7,081,857 B2 7/2006 Kinnunen et al.
7,084,831 B2 8/2006 Takagi et al.
7,099,690 B2 8/2006 Milosavljevic
7,113,133 B2 9/2006 Chen et al.
7,119,749 B2 10/2006 Miyata et al.
7,126,546 B2 10/2006 Annamaa
7,136,019 B2 11/2006 Mikkola
7,142,824 B2 11/2006 Kojima et al.
7,148,847 B2 12/2006 Yuanzhu
7,148,849 B2 12/2006 Lin
7,148,851 B2 12/2006 Takaki et al.
7,170,464 B2 1/2007 Tang et al.
7,176,838 B1 2/2007 Kinezos
7,180,455 B2 2/2007 Oh et al.
7,193,574 B2 3/2007 Chiang et al.
7,205,942 B2 4/2007 Wang et al.
7,218,280 B2 5/2007 Annamaa
7,218,282 B2 5/2007 Humpfer et al.
7,224,313 B2 5/2007 McKinzie, III et al.
7,230,574 B2 6/2007 Johnson
7,237,318 B2 7/2007 Annamaa

(56) References Cited

U.S. PATENT DOCUMENTS

| | | | | |
|---|---|---|---|---|
| 7,256,743 | B2 | 8/2007 | Korva | |
| 7,274,334 | B2 | 9/2007 | O'Riordan et al. | |
| 7,283,097 | B2 | 10/2007 | Wen et al. | |
| 7,289,064 | B2 | 10/2007 | Cheng | |
| 7,292,200 | B2 | 11/2007 | Posluszny et al. | |
| 7,319,432 | B2 | 1/2008 | Andersson | |
| 7,330,153 | B2 | 2/2008 | Rentz | |
| 7,333,067 | B2 | 2/2008 | Hung et al. | |
| 7,339,528 | B2 | 3/2008 | Wang et al. | |
| 7,340,286 | B2 | 3/2008 | Korva et al. | |
| 7,345,634 | B2 | 3/2008 | Ozkar et al. | |
| 7,352,326 | B2 | 4/2008 | Korva | |
| 7,358,902 | B2 | 4/2008 | Erkocevic | |
| 7,382,319 | B2 | 6/2008 | Kawahata et al. | |
| 7,385,556 | B2 | 6/2008 | Chung et al. | |
| 7,388,543 | B2 | 6/2008 | Vance | |
| 7,391,378 | B2 | 6/2008 | Mikkola | |
| 7,405,702 | B2 | 7/2008 | Annamaa et al. | |
| 7,417,588 | B2 | 8/2008 | Castany et al. | |
| 7,423,592 | B2 | 9/2008 | Pros et al. | |
| 7,432,860 | B2 | 10/2008 | Huynh | |
| 7,439,929 | B2 | 10/2008 | Ozkar | |
| 7,468,700 | B2 | 12/2008 | Milosavlejevic | |
| 7,468,709 | B2 | 12/2008 | Niemi | |
| 7,498,990 | B2 | 3/2009 | Park et al. | |
| 7,501,983 | B2 | 3/2009 | Mikkola | |
| 7,502,598 | B2 | 3/2009 | Kronberger | |
| 7,589,678 | B2 | 9/2009 | Perunka | |
| 7,616,158 | B2 | 11/2009 | Mark et al. | |
| 7,633,449 | B2 | 12/2009 | Oh | |
| 7,663,551 | B2 | 2/2010 | Nissinen | |
| 7,679,565 | B2 | 3/2010 | Sorvala | |
| 7,692,543 | B2 | 4/2010 | Copeland | |
| 7,710,325 | B2 | 5/2010 | Cheng | |
| 7,724,204 | B2 | 5/2010 | Annamaa | |
| 7,760,146 | B2 | 7/2010 | Ollikainen | |
| 7,764,245 | B2 | 7/2010 | Loyet | |
| 7,786,938 | B2 | 8/2010 | Sorvala | |
| 7,800,544 | B2 | 9/2010 | Thornell-Pers | |
| 7,830,327 | B2 | 11/2010 | He | |
| 7,889,139 | B2 | 2/2011 | Hobson et al. | |
| 7,889,143 | B2 | 2/2011 | Milosavljevic | |
| 7,901,617 | B2 | 3/2011 | Taylor | |
| 7,916,086 | B2 | 3/2011 | Koskiniemi et al. | |
| 7,963,347 | B2 | 6/2011 | Pabon | |
| 7,973,720 | B2 | 7/2011 | Sorvala | |
| 8,049,670 | B2 | 11/2011 | Jung et al. | |
| 8,179,322 | B2 | 5/2012 | Nissinen | |
| 2001/0050636 | A1 | 12/2001 | Weinberger | |
| 2002/0183013 | A1 | 12/2002 | Auckland et al. | |
| 2002/0196192 | A1 | 12/2002 | Nagumo et al. | |
| 2003/0146873 | A1 | 8/2003 | Blancho | |
| 2004/0053635 | A1* | 3/2004 | Haapala et al. | 455/522 |
| 2004/0090378 | A1 | 5/2004 | Dai et al. | |
| 2004/0145525 | A1 | 7/2004 | Annabi et al. | |
| 2004/0171403 | A1 | 9/2004 | Mikkola | |
| 2005/0057401 | A1 | 3/2005 | Yuanzhu | |
| 2005/0099347 | A1 | 5/2005 | Yamaki | |
| 2005/0159131 | A1 | 7/2005 | Shibagaki et al. | |
| 2005/0176481 | A1 | 8/2005 | Jeong | |
| 2006/0071857 | A1 | 4/2006 | Pelzer | |
| 2006/0192723 | A1 | 8/2006 | Harada | |
| 2007/0042615 | A1 | 2/2007 | Liao | |
| 2007/0082789 | A1 | 4/2007 | Nissila | |
| 2007/0085754 | A1* | 4/2007 | Ella et al. | 343/862 |
| 2007/0152881 | A1 | 7/2007 | Chan | |
| 2007/0188388 | A1 | 8/2007 | Feng | |
| 2008/0055164 | A1 | 3/2008 | Zhang et al. | |
| 2008/0059106 | A1 | 3/2008 | Wight | |
| 2008/0088511 | A1 | 4/2008 | Sorvala | |
| 2008/0266199 | A1 | 10/2008 | Milosavljevic | |
| 2009/0009415 | A1 | 1/2009 | Tanska | |
| 2009/0135066 | A1 | 5/2009 | Raappana et al. | |
| 2009/0174604 | A1 | 7/2009 | Keskitalo | |
| 2009/0196160 | A1 | 8/2009 | Crombach | |
| 2009/0197654 | A1 | 8/2009 | Teshima | |
| 2009/0231213 | A1 | 9/2009 | Ishimiya | |
| 2010/0220016 | A1 | 9/2010 | Nissinen | |
| 2010/0244978 | A1 | 9/2010 | Milosavljevic | |
| 2010/0309092 | A1 | 12/2010 | Lambacka | |
| 2011/0102290 | A1 | 5/2011 | Milosavljevic | |
| 2011/0133994 | A1 | 6/2011 | Korva | |
| 2012/0119955 | A1 | 5/2012 | Milosavljevic | |

FOREIGN PATENT DOCUMENTS

| | | | |
|---|---|---|---|
| DE | 10104862 | | 8/2002 |
| DE | 101 50 149 | A1 | 4/2003 |
| EP | 0208424 | | 1/1987 |
| EP | 0278069 | | 8/1988 |
| EP | 0279050 | | 8/1988 |
| EP | 0339822 | | 3/1989 |
| EP | 0 332 139 | | 9/1989 |
| EP | 0 376 643 | A2 | 4/1990 |
| EP | 0383292 | | 8/1990 |
| EP | 0399975 | | 12/1990 |
| EP | 0400872 | | 12/1990 |
| EP | 0401839 | | 9/1991 |
| EP | 0447218 | | 9/1994 |
| EP | 0615285 | | 10/1994 |
| EP | 0621653 | | 2/1995 |
| EP | 0 749 214 | | 12/1996 |
| EP | 0637094 | | 1/1997 |
| EP | 0 759 646 | A1 | 2/1997 |
| EP | 0 766 341 | | 2/1997 |
| EP | 0 766 340 | | 4/1997 |
| EP | 0751043 | | 4/1997 |
| EP | 0807988 | | 11/1997 |
| EP | 0 831 547 | A2 | 3/1998 |
| EP | 0851530 | | 7/1998 |
| EP | 0856907 | | 8/1998 |
| EP | 1 294 048 | | 1/1999 |
| EP | 0892459 | | 1/1999 |
| EP | 0766339 | | 2/1999 |
| EP | 0 942 488 | A2 | 9/1999 |
| EP | 0993070 | A1 | 4/2000 |
| EP | 1 003 240 | A2 | 5/2000 |
| EP | 1006605 | | 6/2000 |
| EP | 1006606 | | 6/2000 |
| EP | 1014487 | | 6/2000 |
| EP | 1024553 | | 8/2000 |
| EP | 1026774 | | 8/2000 |
| EP | 0999607 | | 10/2000 |
| EP | 1 052 723 | | 11/2000 |
| EP | 1052722 | | 11/2000 |
| EP | 1 063 722 | A2 | 12/2000 |
| EP | 1067627 | | 1/2001 |
| EP | 1094545 | | 4/2001 |
| EP | 1 102 348 | | 5/2001 |
| EP | 1098387 | | 5/2001 |
| EP | 1 113 524 | | 7/2001 |
| EP | 1 113 524 | A2 | 7/2001 |
| EP | 1113524 | | 7/2001 |
| EP | 1 128 466 | A2 | 8/2001 |
| EP | 1 139 490 | | 10/2001 |
| EP | 1 146 589 | | 10/2001 |
| EP | 1 162 688 | | 12/2001 |
| EP | 1162688 | | 12/2001 |
| EP | 1 248 316 | | 9/2002 |
| EP | 0923158 | | 9/2002 |
| EP | 1 267 441 | | 12/2002 |
| EP | 1271690 | | 1/2003 |
| EP | 1 294 049 | A1 | 3/2003 |
| EP | 1306922 | | 5/2003 |
| EP | 1 329 980 | | 7/2003 |
| EP | 1 351 334 | | 8/2003 |
| EP | 1 361 623 | | 11/2003 |
| EP | 1248316 | | 1/2004 |
| EP | 1396906 | | 3/2004 |
| EP | 1 406 345 | | 4/2004 |
| EP | 1 414 108 | | 4/2004 |
| EP | 1 432 072 | | 6/2004 |
| EP | 1 437 793 | | 7/2004 |
| EP | 1439603 | | 7/2004 |

(56) References Cited

FOREIGN PATENT DOCUMENTS

| | | | |
|---|---|---|---|
| EP | 1 445 822 | | 8/2004 |
| EP | 1 453 1 | | 9/2004 |
| EP | 1 469 549 | | 10/2004 |
| EP | 1220456 | | 10/2004 |
| EP | 1467456 | | 10/2004 |
| EP | 1 482 592 | | 12/2004 |
| EP | 1 498 984 | | 1/2005 |
| EP | 1 564 839 | | 1/2005 |
| EP | 1170822 | | 4/2005 |
| EP | 1 544 943 | | 6/2005 |
| EP | 1753079 | | 2/2007 |
| EP | 1 791 213 | | 5/2007 |
| EP | 1843432 | | 10/2007 |
| FI | 20020829 | | 11/2003 |
| FI | 118782 | B1 | 4/2007 |
| FR | 2553584 | | 10/1983 |
| FR | 2724274 | | 3/1996 |
| FR | 2873247 | | 1/2006 |
| GB | 2266997 | | 11/1993 |
| GB | 2 360 422 | A | 9/2001 |
| GB | 239246 | | 12/2003 |
| JP | 1984202831 | | 11/1984 |
| JP | 600206304 | | 10/1985 |
| JP | 1986245704 | | 11/1986 |
| JP | 06152463 | | 5/1994 |
| JP | 199513 234 | | 5/1995 |
| JP | 1995221536 | | 8/1995 |
| JP | 7249923 | | 9/1995 |
| JP | 1995307612 | | 11/1995 |
| JP | 08216571 | | 8/1996 |
| JP | 09083242 | | 3/1997 |
| JP | 9260934 | | 10/1997 |
| JP | 9307344 | | 11/1997 |
| JP | 10 028013 | | 1/1998 |
| JP | 10107671 | | 4/1998 |
| JP | 10173423 | | 6/1998 |
| JP | 10190345 | A | 7/1998 |
| JP | 10 209733 | | 8/1998 |
| JP | 10224142 | | 8/1998 |
| JP | 10 327011 | | 12/1998 |
| JP | 10322124 | | 12/1998 |
| JP | 11 004117 | | 1/1999 |
| JP | 1999004113 | | 1/1999 |
| JP | 11 068456 | | 3/1999 |
| JP | 11127010 | | 5/1999 |
| JP | 11136025 | | 5/1999 |
| JP | 199127014 | | 5/1999 |
| JP | 11 355033 | | 12/1999 |
| JP | 2000278028 | | 10/2000 |
| JP | 200153543 | | 2/2001 |
| JP | 2001267833 | | 9/2001 |
| JP | 2001217631 | | 10/2001 |
| JP | 2001326513 | | 11/2001 |
| JP | 2002319811 | A | 10/2002 |
| JP | 2002329541 | | 11/2002 |
| JP | 2002335117 | | 11/2002 |
| JP | 200360417 | | 2/2003 |
| JP | 2003124730 | | 4/2003 |
| JP | 2003179426 | | 6/2003 |
| JP | 2003318638 | | 11/2003 |
| JP | 2004112028 | | 4/2004 |
| JP | 2004363859 | | 12/2004 |
| JP | 2005005985 | | 1/2005 |
| JP | 2005252661 | | 9/2005 |
| KR | 20010080521 | | 10/2001 |
| KR | 10-2006-7027462 | | 12/2002 |
| KR | 20020096016 | | 12/2002 |
| SE | 511900 | | 12/1999 |
| WO | WO 92/00635 | | 1/1992 |
| WO | WO 96/27219 | | 9/1996 |
| WO | WO 98/01919 | | 1/1998 |
| WO | WO 98/01921 | | 1/1998 |
| WO | WO 98/37592 | | 8/1998 |
| WO | WO 99/30479 | | 6/1999 |
| WO | WO 00/36700 | | 6/2000 |
| WO | WO 01/20718 | | 3/2001 |
| WO | WO 01/24316 | | 4/2001 |
| WO | WO 01/28035 | | 4/2001 |
| WO | WO 01/29927 | | 4/2001 |
| WO | WO 01/33665 | | 5/2001 |
| WO | WO 01/61781 | | 8/2001 |
| WO | WO 01/91236 | | 11/2001 |
| WO | WO 02/008672 | | 1/2002 |
| WO | WO 02/11236 | A1 | 2/2002 |
| WO | WO 02/13307 | | 2/2002 |
| WO | WO 02/41443 | | 5/2002 |
| WO | WO 02/067375 | | 8/2002 |
| WO | WO 02/078123 | | 10/2002 |
| WO | WO 02/078124 | | 10/2002 |
| WO | WO 03/094290 | | 11/2003 |
| WO | WO 2004/017462 | | 2/2004 |
| WO | WO 2004/036778 | | 4/2004 |
| WO | WO 2004/057697 | | 7/2004 |
| WO | WO 2004/070872 | | 8/2004 |
| WO | WO 2004/100313 | | 11/2004 |
| WO | WO 2004/112189 | A | 12/2004 |
| WO | WO 2005/011055 | | 2/2005 |
| WO | WO 2005/018045 | | 2/2005 |
| WO | WO 2005/034286 | | 4/2005 |
| WO | WO 2005/038981 | A1 | 4/2005 |
| WO | WO 2005/055364 | | 6/2005 |
| WO | WO 2005/062416 | | 7/2005 |
| WO | WO 2006/000631 | A1 | 1/2006 |
| WO | WO 20061000650 | | 1/2006 |
| WO | WO 2006/051160 | A1 | 5/2006 |
| WO | WO 2006/084951 | A1 | 8/2006 |
| WO | WO 2006/097567 | | 9/2006 |
| WO | WO 2007/000483 | | 1/2007 |
| WO | WO 2007/000483 | A1 | 1/2007 |
| WO | WO 2007/012697 | | 2/2007 |
| WO | WO 2007/039667 | | 4/2007 |
| WO | WO 2007/039668 | | 4/2007 |
| WO | WO 2007/042614 | | 4/2007 |
| WO | WO 2007/042615 | | 4/2007 |
| WO | WO 2007/050600 | | 5/2007 |
| WO | WO 2007/080214 | | 7/2007 |
| WO | WO 2007/098810 | | 9/2007 |
| WO | WO 2007/138157 | | 12/2007 |
| WO | WO 2008/059106 | | 3/2008 |
| WO | WO 2008/129125 | | 10/2008 |
| WO | WO 2009/027579 | | 5/2009 |
| WO | WO 2009/095531 | | 8/2009 |
| WO | WO 2009/106682 | | 9/2009 |
| WO | WO 2010/122220 | | 10/2010 |

OTHER PUBLICATIONS

"Dual Band Antenna for Hand Held Portable Telephones", Liu et al., Electronics Letters, vol. 32, No. 7, 1996, pp. 609-610.

"Improved Bandwidth of Microstrip Antennas using Parasitic Elements," IEE Proc. vol. 127, Pt. H. No. 4, Aug. 1980.

"A 13.56MHz RFID Device and Software for Mobile Systems", by H. Ryoson, et al., Micro Systems Network Co., 2004 IEEE, pp. 241-244.

"A Novel Approach of a Planar Multi-Band Hybrid Series Feed Network for Use in Antenna Systems Operating at Millimeter Wave Frequencies," by M.W. Elsalial and B.L. Hauck, Rockwell Collins, Inc., 2003 pp. 15-24, waelsall@rockwellcollins.com and blhauck@rockwellcollins.com.

Abedin, M. F. And M. Ali, "Modifying the ground plane and its erect on planar inverted-F antennas (PIFAs) for mobile handsets," *IEEE Antennas and Wireless Propagation Letters*, vol. 2, 226-229, 2003.

C. R. Rowell and R. D. Murch, "A compact PIFA suitable for dual frequency 900/1800-MHz operation," *IEEE Trans. Antennas Propag.*, vol. 46, No. 4, pp. 596-598, Apr. 1998.

Cheng- Nan Hu, Willey Chen, and Book Tai, "A Compact Multi-Band Antenna Design for Mobile Handsets", *APMC 2005 Proceedings*.

Endo, T., Y. Sunahara, S. Satoh and T. Katagi, "Resonant Frequency and Radiation Efficiency of Meander Line Antennas," Electronics and Commu-nications in Japan, Part 2, vol. 83, No. 1, 52-58, 2000.

(56) References Cited

OTHER PUBLICATIONS

European Office Action, May 30, 2005 issued during prosecution of EP 04 396 001.2-1248.
Examination Report dated May 3, 2006 issued by the EPO for European Patent Application No. 04 396 079.8.
F.R. Hsiao, et al. "A dual-band planar inverted-F patch antenna with a branch-line slit," *Microwave Opt. Technol. Lett.*, vol. 32, Feb. 20, 2002.
Griffin, Donald W. et al., "Electromagnetic Design Aspects of Packages for Monolithic Microwave Integrated Circuit-Based Arrays with Integrated Antenna Elements", IEEE Transactions on Antennas and Propagation, vol. 43, No. 9, pp. 927-931, Sep. 1995.
Guo, Y. X. and H. S. Tan, "New compact six-band internal antenna," *IEEE Antennas and Wireless Propagation Letters*, vol. 3, 295-297, 2004.
Guo, Y. X. And Y.W. Chia and Z. N. Chen, "Miniature built-in quadband antennas for mobile handsets", *IEEE Antennas Wireless Propag. Lett.*, vol. 2, pp. 30-32, 2004.
Hoon Park, et al. "Design of an Internal antenna with wide and multiband characteristics for a mobile handset", *IEEE Microw. & Opt. Tech. Lett.* vol. 48, No. 5, May 2006.
Hoon Park, et al. "Design of Planar Inverted-F Antenna With Very Wide Impedance Bandwidth", *IEEE Microw. & Wireless Comp., Lett.*, vol. 16, No. 3, pp. 113-115-, Mar. 2006.
Hossa, R., A. Byndas, and M. E. Bialkowski, "Improvement of compact terminal antenna performance by incorporating open-end slots in ground plane," *IEEE Microwave and Wireless Components Letters*, vol. 14, 283-285, 2004.
I. Ang, Y. X. Guo, and Y. W. Chia, "Compact internal quad-band antenna for mobile phones" *Micro. Opt. Technol. Lett.*, vol. 38, No. 3 pp. 217-223 Aug. 2003.
International Preliminary Report on Patentability for International Application No. PCT/F12004/000554, date of issuance of report May 1, 2006.
Jing, X., et al.; "Compact Planar Monopole Antenna for Multi-Band Mobile Phones"; Microwave Conference Proceedings, 4.-7.12.2005. APMC 2005, Asia—Pacific Conference Proceedings, vol. 4.
Kim, B, C., J. H. Yun, and H. D, Choi, "Small wideband PIFA for mobile phones at 1800 MHz," *IEEE International Conference on Vehicular Technology*, 27 29, Daejeon, South Korea, May 2004.
Kim, Kihong et al., "Integrated Dipole Antennas on Silicon Substrates for Intra-Chip Communication", IEEE, pp. 1582-1585, 1999.
Kivekas., O., J. Ollikainen, T. Lehtiniemi, and P. Vainikainen, "Bandwidth, SAR, and eciency of internal mobile phone antennas," *IEEE Transactions on Electromagnetic Compatibility*, vol. 46, 71 86, 2004.
K-L Wong, *Planar Antennas for Wireless Communications.*, Hoboken, NJ: Willey, 2003, ch. 2.
Lindberg., P. and E. Ojefors, "A bandwidth enhancement technique for mobile handset antennas using wavetraps," *IEEE Transactions on Antennas and Propagation*, vol. 54, 2226{2232, 2006.
Marta Martinez-Vazquez, et al., "Integrated Planar Multiband Antennas for Personal Communication Handsets", *IEEE Trasactions on Antennas and propagation*, vol. 54, No. 2, Feb. 2006.
P. Ciais, et al., "Compact Internal Multiband Antennas for Mobile and WLAN Standards", Electronic Letters, vol. 40, No. 15, pp. 920-921, Jul. 2004.
P. Ciais, R. Staraj, G. Kossiavas, and C. Luxey, "Design of an internal quadband antenna for mobile phones", *IEEE Microwave Wireless Comp. Lett.*, vol. 14, No. 4, pp. 148-150, Apr. 2004.
P. Salonen, et al. "New slot configurations for dual-band planar inverted-F antenna," *Microwave Opt. Technol.*, vol. 28, pp. 293-298, 2001.
Papapolymerou, loannis et al., "Micromachined Patch Antennas", IEEE Transactions on Antennas and Propagation, vol. 46, No. 2, pp. 275-283, Feb. 1998.
Product of the Month, RFDesign, "GSM/GPRS Quad Band Power Amp Includes Antenna Switch," 1 page, reprinted Nov. 2004 issue of RF Design (www.rfdesign.com), Copyright 2004, Freescale Semiconductor, RFD-24-EK.
S. Tarvas, et al. "An internal dual-band mobile phone antenna," in 2000 *IEEE Antennas Propagat Soc. Int. Symp. Dig.*, pp. 266-269, Salt Lake City, UT, USA.
Wang, F., Z. Du, Q. Wang, and K. Gong, "Enhanced-bandwidth PIFA with T-shaped ground plane," *Electronics Letters*, vol. 40, 1504-1505, 2004.
Wang, H.; "Dual-Resonance Monopole Antenna with Tuning Stubs"; IEEE Proceedings, Microwaves, Antennas & Propagation, vol. 153, No. 4, Aug. 2006; pp. 395-399.
Wong, K., et al.; "A Low-Profile Planar Monopole Antenna for Multiband Operation of Mobile Handsets"; IEEE Transactions on Antennas and Propagation, Jan. '03, vol. 51, No. 1.
X.-D. Cal and J.-Y. Li, Analysis of asymmetric TEM cell and its optimum design of electric field distribution, IEE Proc 136 (1989), 191-194.
X.-Q. Yang and K.-M. Huang, Study on the key problems of interaction between microwave and chemical reaction, Chin Jof Radio Sci 21 (2006), 802-809.
Chiu, C.-W., et al., "A Meandered Loop Antenna for LTE/WWAN Operations in a Smartphone," Progress in Electromagnetics Research C, vol. 16, pp. 147-160, 2010.
Lin, Sheng-Yu; Liu, Hsien-Wen; Weng, Chung-Hsun; and Yang, Chang-Fa, "A miniature Coupled loop Antenna to be Embedded in a Mobile Phone for Penta-band Applications," Progress in Electromagnetics Research Symposium Proceedings, Xi'an, China, Mar. 22-26, 2010, pp. 721-724.
Zhang, Y,Q., et al. "Band-Notched UWB Crossed Semi-Ring Monopole Antenna," Progress in Electronics Research C, vol. 19, 107-118, 2011, pp. 107-118.
Joshi, Ravi Kumar, et al. "Broadband Concentric Rings Fractal Slot Antenna," Department of Electrical Engineering, Indian Institute of Technology, Kanpur-208 016, India.
Singh, Rajender, "Broadband Planar Monopole Antennas," M.Tech credit seminar report, Electronic Systems group, EE Dept, IIT Bombay, Nov., 2003, pp. 1-24.
Gobien, Andrew, T. "*Investigation of Low Profile Antenna Designs for Use in Hand-Held Radios*,"Ch.3, *The Inverted-L Antenna and Variations*; Aug. 1997, pp. 42-76.
See, C.H et al., "Design of Planar Metal-Plate Monopole Antenna for Third Generation Mobile Handsets," Telecommunications Research Centre, Bradford University, 2005, pp. 27-30.
Chen, Jin-Sen, et al., "CPW-fed Ring Slot Antenna with Small Ground Plane," Department of Electronic Engineering, Cheng Shiu University.
"LTE—an introduction," Ericsson White Paper, Jun. 2009, pp. 1-16.
"Spectrum Analysis for Future LTE Deployments," Motorola White Paper, 2007, pp. 1-8.
Chi, Yun-Wen, et al. "Quarter-Wavelength Printed Loop Antenna With an Internal Printed Matching Circuit for GSM/DCS/PCS/UMTS Operation in the Mobile Phone," IEEE Transactions on Antennas and Propagation, vol. 57, No. 9m Sep. 2009, pp. 2541-2547.
Wong, Kin-Lu, et al. "Planar Antennas for WLAN Applications," Dept. of Electrical Engineering, National Sun Yat-Sen University, Sep. 2002 Ansoft Workshop, pp. 1-45.
"λ/4 printed monopole antenna for 2.45GHz," Nordic Semiconductor, White Paper, 2005, pp. 1-6.
White, Carson, R., "Single—and Dual-Polarized Slot and Patch Antennas with Wide Tuning Ranges," The University of Michigan, 2008.
Extended European Search Report dated Jan. 30, 2013, issued by the EPO for European Patent Application No. 12177740.3.

* cited by examiner

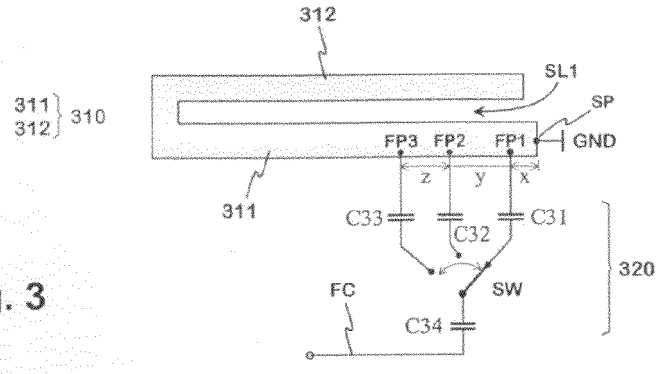
Fig. 3
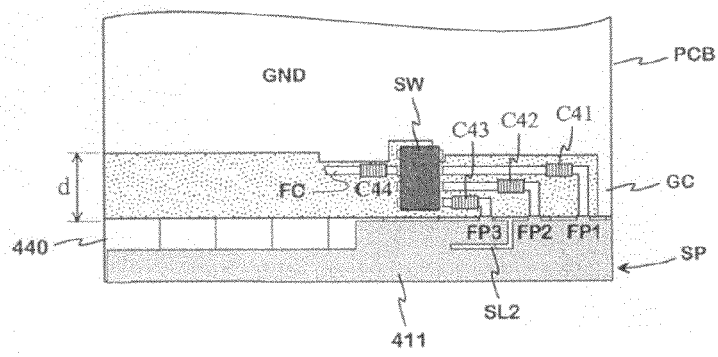
Fig. 4a
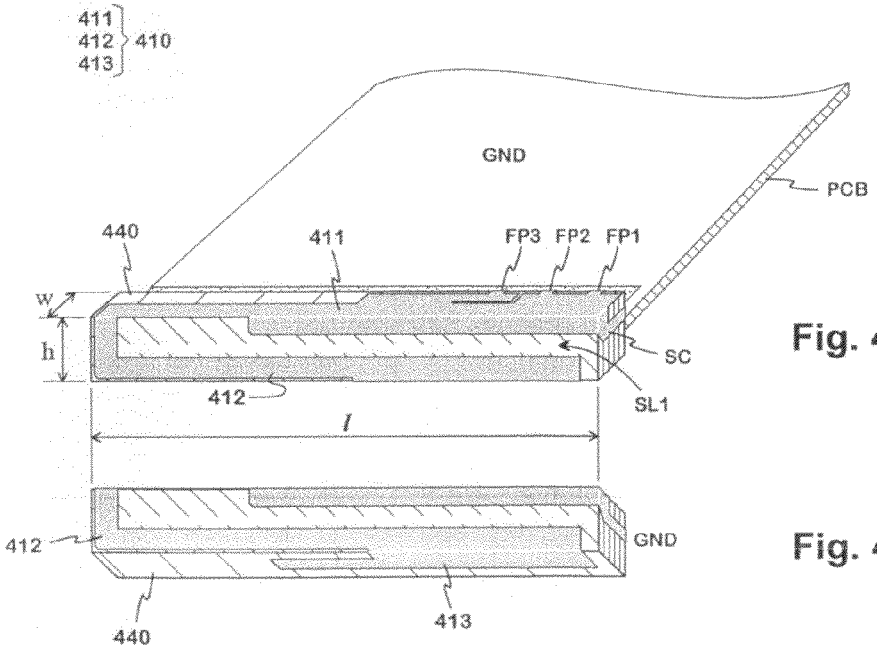
Fig. 4b
Fig. 4c

ADJUSTABLE MULTI-BAND ANTENNA AND METHODS

The present invention relates generally to antennas for use in e.g., mobile terminals, wireless devices, or portable radio devices, and methods of utilizing and producing the same.

PRIORITY AND RELATED APPLICATIONS

This application is a National Stage Application of, and claims priority to, International Application No. PCT/FI2008/050469 under 35 U.S.C. 371, filed Aug. 8, 2008, which claims the benefit of priority to Finnish Patent Application Serial No. 20075597, filed on Aug. 30, 2007, the priority benefit of which is also herein claimed, each of the foregoing being incorporated herein by reference in its entirety.

COPYRIGHT

A portion of the disclosure of this patent document contains material that is subject to copyright protection. The copyright owner has no objection to the facsimile reproduction by anyone of the patent document or the patent disclosure, as it appears in the Patent and Trademark Office patent files or records, but otherwise reserves all copyright rights whatsoever.

BACKGROUND OF THE INVENTION

1. Field of Invention
2. Description of Related Technology

The adjustability of an antenna means in this description, that resonance frequencies of the antenna can be changed electrically. The aim is that the operating band of the antenna around a resonance frequency always covers the frequency range, which the function presumes at each time. There are different causes for the need for adjustability. The portable radio devices, like mobile terminals, have become smaller in all directions, also thickness-wise. In this case, regarding for example the planar antenna which is a very common antenna type in mobile terminals, the distance between the radiating plane and the ground plane unavoidably becomes shorter. This results in e.g. that the antenna's bandwidths will decrease. In addition, the reduction of the size of the devices means that also their ground plane becomes smaller. This leads to lowering of the capability of the planar antenna, because the antenna resonances become weaker and due to the ground plane's own resonances occurring at useless frequencies. Then, as a mobile terminal is intended for operating in a plurality of radio systems having frequency ranges relatively close to each other, it becomes more difficult or impossible to cover frequency ranges used by more than one radio system. Such a system pair is for instance GSM850 and GSM900 (Global System for Mobile telecommunications). Correspondingly, securing the function that conforms to specifications in both transmitting and receiving bands of a single system can become more difficult. In addition, if the system uses sub-band division it is advantageous from the point of view of the radio connection quality, if the resonance frequency of the antenna can be tuned in a sub-band being used at each time.

One possibility for reducing the antenna size is to implement it without the ground plane below the radiator. In this case the radiator can be of monopole type, then being resulted for example in an ILA (Inverted L-antenna) structure or the radiator can have also a ground contact, then being resulted in an IFA (Inverted F-antenna) structure.

In the invention described here the antenna adjustment is implemented by a switch. The use of switches for the purpose in question is well known as such. For example the publication EP1113 524 discloses an antenna, in which a planar radiator can at a certain point be connected to the ground by a switch. When the switch is closed, the electric length of the radiator is decreased, in which case the antenna resonance frequency becomes higher and the operating band corresponding to it is displaced upwards. A capacitor can be in series with the switch to set the band displacement as large as desired. In this solution the adjusting possibilities are very restricted.

FIG. 1 shows an example of the ILA type with a switch, known from the publication WO 2007/042615. A portion of the circuit board PCB of a radio device is seen in the figure. The monopole radiator 110 is a plate-like and rigid sheet metal strip. It has been connected to the antenna feed conductor FC at the feed point FP being located near a corner of the circuit board. The radiator is directed from that point first over the edge of the end of the circuit board outside the board and turns after that onwards level with the upper surface of the circuit board in the direction of the end. On the circuit board there is the signal ground GND at a certain distance from the radiator 110. The radiator has a perpendicular fold part at the outer edge of the portion along the end of the circuit board to increase its electric length. On the circuit board, in the end on the radiator side, there is the adjusting circuit 120 of the antenna. The adjusting circuit is marked on the circuit board as an area confined by a broken line and shown as a block diagram in the side drawing. This drawing discloses that the adjusting circuit 120 has been connected between the antenna feed conductor FC and the signal ground GND. The adjusting circuit comprises an LC circuit, a multiple-way switch SW and three alternative reactive structure parts X1, X2, X3. The LC circuit has been connected to the feed conductor at its one end and to the switch input at its other end. Its aim is to attenuate the harmonic frequency components being generated in the switch and to function as an electrostatic discharge (ESD) protector of the switch. The switch SW has three outputs, to one of which the switch input can be connected at a time. Each output of the switch has been fixedly connected to one of said reactive structure parts, the reactances of which exist against the signal ground. The interchanging of the reactance by controlling the switch changes the resonance frequency of the antenna and thus the place of its operating band. The operating band of the antenna then has three alternative places in this example.

A drawback in the solution according to FIG. 1 and other like it is that good band characteristics and a sufficient efficiency demand a remarkable long distance between the radiator and ground plane. This again means that the space requirement for the antenna still is, also in this case, higher than the desirable one. In addition, it is difficult to arrange so that the antenna matching is good in both lower and upper operating band. A poor matching means also low efficiency.

An object of the invention is to implement the adjustment of an antenna in a new and advantageous way. In one aspect of the invention, the antenna is made adjustable in such a way that the antenna feed can be connected by a multiple-way switch to at least two alternative points in the radiator. When the feed point is changed, the resonance frequencies and thus the operating bands of the antenna change. In one embodiment, in addition to the basic dimensions of the antenna, the distance of each feed point to other feed points and possible short-circuit point in the radiator, the value of the series capacitance belonging to a reactive circuit between the feed point and switch and the distance of the ground plane from the radiator are variables in the antenna design. In another embodiment, a tuning slot between the feed points can be used.

An advantage of the invention is that by choosing values to the above-mentioned variables suitably, the displacement of an operation band can be made relatively large, when the switch state is changed. In this way a relatively narrow band basic antenna functions in practice as a wide band antenna, because only a part of this wide band is needed at a time. Another advantage of the invention is that the displacements of two operating bands can be implemented independently from each other. A further advantage of the invention is that the efficiency of the antenna is better than the one of the corresponding known antennas. This is due to that when there are more than one feed point, by choice of their places the antenna matching can be improved in each operating band. This also results in that the space required for the antenna according to the invention is small, because the edge of the ground plane need not to be so far from the radiator than in the corresponding known antennas. Alternatively, the antenna component proper can be implemented in a smaller size. A further advantage of the invention is that the antenna structure is simple, which means relatively low production costs.

In a second aspect of the invention, a multiband antenna is disclosed. In one embodiment, the antenna has at least a lower operating frequency band and an upper operating frequency band, and comprises: a dielectric element having a first dimension; a conductive coating deposited on the dielectric element, the conductive coating having a first portion and a second portion, wherein the first and second portions are formed substantially parallel to each other along the first dimension; a feed structure, comprising at least a first and a second feed points, the feed structure coupled to the conductive coating; and a nonconductive slot formed between the first and second portions along the first dimension. The slot is configured to form a quarter wave resonator in the upper operating band; and the first and second portions cooperate to form a quarter wave resonator in the lower operating band.

In one variant, the first dimension comprises a substantially transverse dimension.

In another variant, the radiating element further comprises a tuning slot disposed between the first and the second feed points.

In yet another variant, the antenna further comprises: a signal ground; at least first and second impedance circuits; and a multi-way switch, comprising: at least one input port; and at least a first and a second output ports. The input port of the multi-way switch is coupled to the radiating element; and the at least first and second output ports of the multi-way switch are coupled to the signal ground via the least a first and a second impedance circuits, respectively. The radiating element may be short-circuited to the signal ground, thereby forming an in inverted-F antenna structure.

In another variant, the antenna further comprises at least first and second reactive circuits. The first feed point is electrically coupled to a transceiver via the first reactive circuit; and the second feed point is electrically coupled to a transceiver via the second reactive circuit. At least one of the at least first and second reactive circuits comprises a serial capacitor arranged to increase the electric length of the radiating element. Alternatively or in concert, at least one of the at least first and second reactive circuits comprises a low-pass filter configured to substantially mitigate radiation at the harmonic frequencies of a resonance frequency corresponding to at least one operating band.

In a third aspect of the invention, an antenna operable in at least a lower and an upper operating frequency bands is disclosed. In one embodiment, the antenna comprises: a radiating element having at least first and second feed points, a ground point, and a short circuit point; a selector circuit configured to select at least one of the at least lower and upper operating frequency bands, the selector circuit comprising: a first multi-way switch, having at least one input port and at least first and second output ports; and at least first and second reactive circuits. The first and second feed points are coupled to the first and second output ports through the first and second reactive circuits, respectively.

In a fourth aspect of the invention, a mobile radio device is disclosed. In one embodiment, the device comprises an antenna operable in at least a lower and an upper operating frequency bands, a feed structure, and a signal ground, the antenna comprising: a radiating element having at least first and second feed points, a ground point, and a short circuit point; a selector circuit configured to select at least one of the at least lower and upper operating frequency bands. The selector circuit comprises: a first multi-way switching element, having at least one input port and at least first and second output ports; and at least first and second reactive circuits. The first and second feed points are coupled to the first and second output ports through the first and second reactive circuits, respectively; and the at least one input port is configured to be coupled to the antenna through the feed structure.

In one variant, the radiating element is electrically coupled to the mobile radio device only via the at least a first and a second feed points, thereby forming an inverted-L antenna structure.

In a fifth aspect of the invention, a method of operating multi-band antenna is disclosed. In one embodiment, the antenna comprises a radiating element, and at least first and second feed points, and the method comprises: selectively electrically coupling the first feed point to a transceiver via a first of a plurality of reactive circuits; or selectively electrically coupling the second feed point to a transceiver via a second of a plurality of reactive circuits. The first and second reactive circuits cause the antenna to operate in first and second frequency bands, respectively.

In one variant, the radiator element further comprises a first portion, a second portion, and a tuning circuit, and the method further comprises utilizing the tuning circuit to selectively alter at least one of the first and second frequency bands.

In a sixth aspect of the invention, an adjustable antenna of a radio device is disclosed. In one embodiment, the radio device comprises an antenna port, and the antenna comprises: a signal ground; a radiating element, comprising: at least a first and a second feed points; a ground point; and a short circuit port; a feed conductor; and an adjusting circuit configured to effect at least one of the at least lower and upper operating frequency bands. The circuit comprises: a first multi-way switch, comprising at least one input port and at least a first and a second output ports; and at least first and second reactive circuits. The first and second feed points are coupled to the first and second output ports through the first and second reactive circuits respectively; and the at least one input port is configured to be coupled to the antenna through the feed conductor.

In one variant, the radiating element further comprises: a first portion; and a second portion, formed substantially parallel with the first portion; and a nonconductive slot formed substantially between the first portion and the second portion The nonconductive slot is sized so as to form a resonance in the upper operating frequency band; and the radiating element is configured to form a resonance in the lower operating frequency band.

In another variant, the multi-way switch is selected from the group consisting of: a field-effect transistor (FET) switch; a pseudomorphic high electron mobility transistor (PHEMT) switch; and microelectromechanical system (MEMS) switch.

Figure 5:
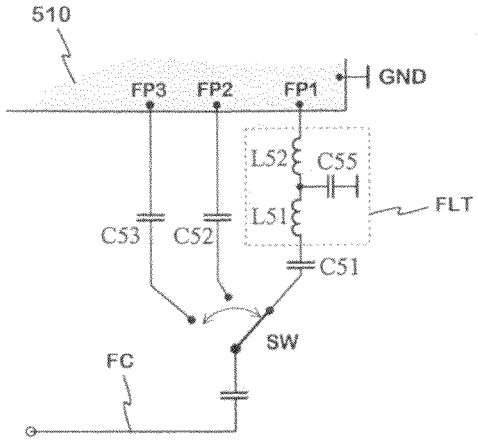
Figure 6:
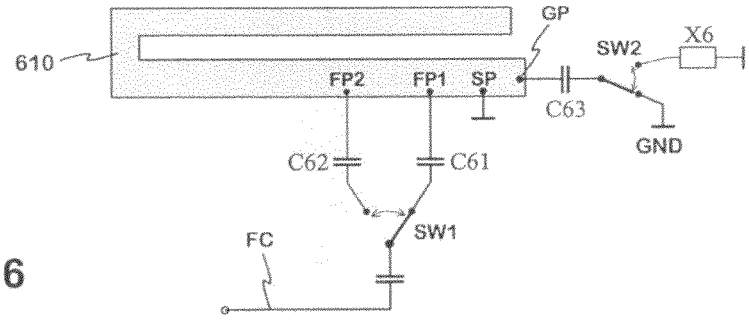
Figure 7:
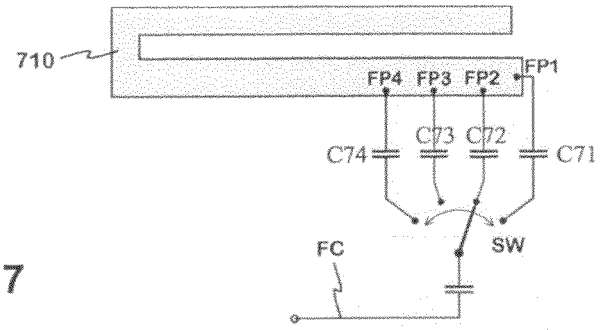
Figure 8:
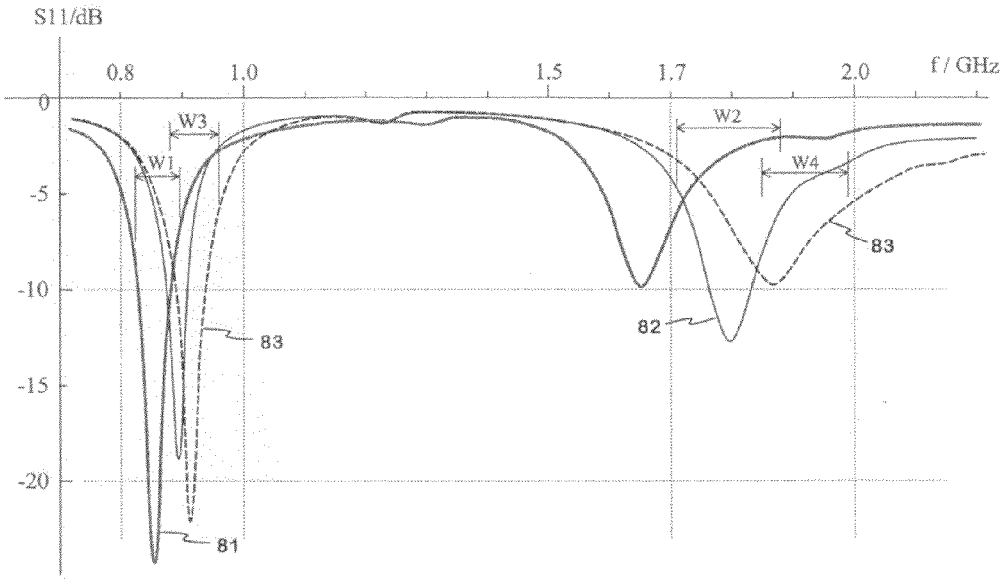
Figure 9:
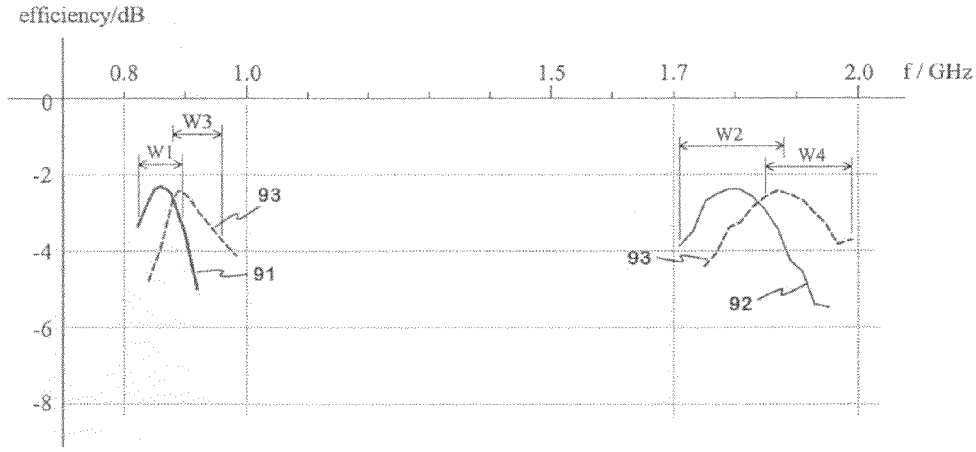

The invention is below described in detail. Reference will be made to the accompanying drawings where FIG. 1 presents an example of an adjustable antenna according to the prior art, FIG. 2 presents as a block diagram the principle of the antenna according to the invention, FIG. 3 presents as a simple diagram an example of the adjustable antenna according to the invention, FIGS. 4*a-c* present an example of the implementation of the solution according to FIG. 3, FIG. 5 presents a second example of the adjustable antenna according to the invention, FIG. 6 presents a third example of the adjustable antenna according to the invention, FIG. 7 presents a fourth example of the adjustable antenna according to the invention, FIG. 8 presents an example of the width and displacement of operation bands of an antenna according to the invention, when the adjusting circuit is controlled, and FIG. 9 presents an example of the efficiency of an antenna according to the invention.

FIG. 1 was already described in conjunction with the description of the prior art.

Figure 2:
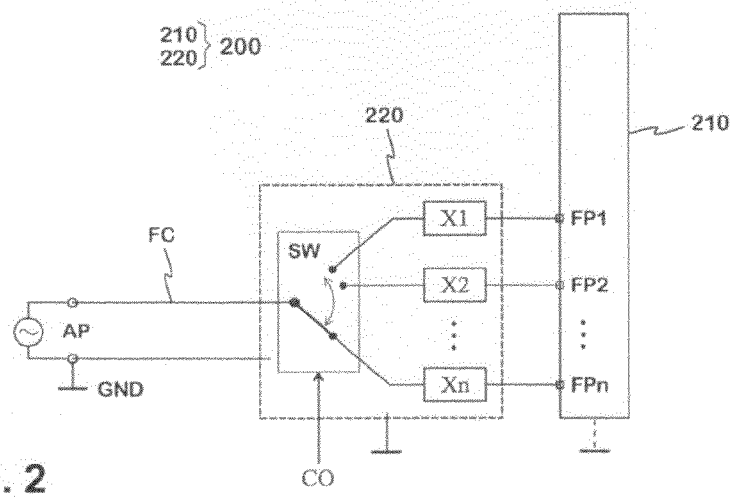

FIG. 2 shows as a block diagram the principle of the antenna according to the invention. The antenna 200 comprises a radiating element 210 and an adjusting circuit 220. Instead of normal one feed point, there are several feed points FP1, FP2, - - - , FPn in the radiating element. Symbol 'n' means that the number of the feed points can be chosen. The radiating element 210 is implemented so that the antenna has at least two separate operating bands, the lower one and the upper one. The adjusting circuit 220 comprises a multi-way switch SW and reactive circuits X1, X2, - - - , Xn. The number of the multi-way terminals, or outputs, of the switch SW is the same as the number of the feed points in the radiating element. Each feed point is connected to a different output of the switch through one reactive circuit. The common terminal, or input, of the switch SW is connected to the feed conductor FC of the antenna and further to the transmitter and receiver of a radio device through the feed conductor and antenna port of the radio device. The switch receives a control CO from the radio device.

By controlling the switch SW it can be selected, to which feed point the antenna feed conductor FC will be connected. When the feed point is changed, the resonance frequency/cies of the antenna shift(s) a certain amount, which means that an operating band is displaced. In this way a relatively wide frequency range can be covered, although the operating band of the antenna would be relatively narrow at a time. An individual reactive circuit may be a capacitive tuning element designed so that the resonance frequency corresponding to the feed through it falls on a desired point. An individual reactive circuit may also be a filter, by which the frequency components above the operating band corresponding the feed point in question are attenuated, to prevent the antenna radiation at the harmonic frequencies of the frequencies of the operating band. Also the special case, where the reactance is zero, in other words a short-circuit, is here considered a reactive circuit.

The structure naturally also includes the common signal ground GND, or more briefly ground, necessary for the function of the structure. The radiator 210 can be connected to the ground from one or more points of it.

FIG. 3 shows as a simple diagram an example of the adjustable antenna according to the invention. The radiating element 310 is here connected to the ground GND from a short-circuit point SP at its one end, the antenna then being of IFA type. The radiating element comprises, starting from the short-circuit point, a first portion 311 and after it a second portion 312, which turns back towards the short-circuited end extending near it. A slot SL1 remains between the first and second portion, which slot is dimensioned so that it resonates at the frequencies of the antenna upper operating band. Thus the slot SL1 is a radiating slot, and the upper operating band is based on it. The lower operating band again is based on the resonance of the whole radiating element 310. Therefore, the whole radiator of the antenna comprises the radiating conductor element and the slot between its portions.

In the example the number of the alternative feed points in the radiating element 310 is three. Closest to the short-circuit point SP there is the first feed point FP1, a little distance from which along the first portion 311 there is the second feed point FP2 and further a little distance along the first portion 311 there is the third feed point FP3. An adjusting circuit 320 with a multiple-way switch SW and four capacitors is located between those feed points and the feed conductor FC coming from the antenna port. In this example the reactice circuits between the multiple-way switch SW and the radiator are mere serial capacitors: the first capacitor C31 is between the first output of the switch and the first feed point FP1, the second capacitor C32 is between the second output of the switch and the second feed point FP2 and the third capacitor C33 is between the third output of the switch and the third feed point FP3. The capacitors C31, C32 and C33 can be used for tuning purposes. They function in all cases also as blocking capacitors preventing the forming of a direct current circuit through the short-circuit conductor of the radiator to the ground, as seen from the control circuit of the switch. On the input side of the switch, in series with the feed conductor FC, there is further the fourth capacitor C34. This functions only as a blocking capacitor preventing the forming of a direct current circuit through the antenna feed conductor, as seen from the control circuit of the switch.

When the feed of the antenna takes place in the first feed point FP1, both the lower and upper resonance frequency and the operating bands corresponding to these frequencies are at the lowest. When the feed is changed to the second feed point FP2, both operating bands shift upwards, and when the feed is changed to the third feed point FP3, the operating bands further shift upwards. If a serial capacitor connecting to one of the feed points is used for tuning purposes, its capacitance is chosen to be so low that the electric length of the radiating element increases compared with the electric length which corresponds to the short-circuit of the capacitor in question. In that case also the place of the operating band in question changes, as well as the amount of its displacement in respect of the places of the operating bands, which correspond to the other feed points. Naturally also the distances between the feed points and their distance from the short-circuit point of the radiating element effect the amount of the displacements. In FIG. 3 the symbol x means the distance of the first feed point FP1 from the short-circuit point, y means the distance between the first and second feed point and z means the distance between the second and third feed point.

FIGS. 4*a-c* show an example of the implementation of the solution according to FIG. 3. The implementation utilizes the circuit board PCB of a radio device. In FIG. 4*a* the structure is seen from above in the direction of the normal of the circuit board and in FIG. 4*b* as a perspective presentation obliquely from above. In FIG. 4*c* the part, which comprises the antenna radiator, is seen as a perspective presentation obliquely from below. This part comprising the radiator consists of the radiating element 410 and its support frame 440. The support frame, or more briefly the frame, is an elongated object made of a low-loss dielectric material with a length l, width w and height h. The frame 440 is attached to the end of the circuit board PCB so that the longitudinal direction of the frame is the width direction, or the direction of the end of the circuit board, the width direction is the longitudinal direction of the circuit board and the height direction is perpendicular to the level of the circuit board. Correspondingly the frame has the upper and lower surface, the first and second end surface, and the inner side surface on the side of the circuit board PCB and the outer side surface. The support frame is hollow, for which reason the radiator is nearly air-insulated. This effects positively on the antenna efficiency.

The radiating element 410 is conductive coating of the frame 440. It has a first portion 411, a second portion 412 and a third portion 413. The first portion 411 covers most of the upper surface of the frame extending from the first end to the second end. The 'end' of the frame means a relatively short part of the frame on the side of the corresponding end surface. The first portion extends also a little to the outer side surface starting from the first end. The second portion 412 is a continuation to the first portion. It travels on the outer side surface from the upper surface near the lower surface in the second end and then to the first end in the longitudinal direction of the frame. The third portion 413 is a continuation to the second portion. It is located on the lower surface and its considerable part joins the second portion at the edge, which unites the lower surface and the outer side surface. The third portion further has a part being directed towards the second end of the frame, the end of which part is the electrically outermost end of the whole radiating element. The radiating element 410 is shaped so that it functions as a quarter-wave resonator in the lower operating band of the antenna. On the outer side surface of the frame, between the first 411 and second 412 portion of the radiating element there is a radiating slot SL1, which is, in accordance with the above-described matter, open in the first end of the frame and closed in the second end of the frame. The slot SL1 is dimensioned so that it functions as a quarter-wave resonator in the upper operating band of the antenna.

The radiating element 410 is connected from the short-circuit point SP in the first end of the frame to the ground plane GND on the circuit board by a short-circuit conductor SC, which is visible in FIGS. 4*b* and 4*c*. The short-circuit conductor goes around from the end surface of the frame to the inner side surface and connects then on the circuit board to the strip conductor GC, which belongs to the ground plane. The feed points of the radiator are located on the upper surface of the frame, on the side of the inner side surface. The first feed point FP1 is closest to the first end surface, relatively close to the short-circuit point SP. The second FP2 and third FP3 feed point are correspondingly located farther from the first end surface, however, also the latter is clearly closer to it than the second end surface.

The adjusting circuit, which is in accordance with the adjusting circuit 320 in FIG. 3, is located on the circuit board PCB next to the antenna component constituted by the frame 440 and the radiating element. Each feed point is connected to one of the serial capacitors C41, C42, C43 by a strip conductor, which falls on the inner side surface of the frame to the circuit board, and is soldered to a strip conductor on the surface of the circuit board. The other terminal of each capacitor C41, C42, C43 is connected to one output of the switch SW, and the input of the switch again to the antenna feed conductor FC through the fourth capacitor C44. The switch SW is an integrated component, in which the connecting parts proper are e.g. of FET (Field Effect Transistor), PHEMT (Pseudomorphic High Electron Mobility Transistor) or MEMS (Micro Electro Mechanical System) type. In the example the switch gets its control through a via from the other side of the circuit board.

There is also a small tuning slot SL2 in the radiating element 410 in the example of FIGS. 4*a-c*, which slot starts between the second FP2 and third FP3 feed point. The tuning slot increases the electric distance of the third feed point from the other feed points and increases for this reason the displacement of at least the lower operating band, when the feed is changed to the third feed point.

In the example the edge of the ground plane on the circuit board PCB is at a certain distance d from the radiating element 410. Increasing the distance d from zero to a certain value increases the bandwidths of the antenna and improves the efficiency, but requires space on the circuit board, on the other hand.

FIG. 5 shows a second example of the adjustable antenna according to the invention. Its adjusting circuit is similar as in FIG. 3 with the difference that the first reactive circuit comprises now a filter FLT in addition to the first serial capacitor C51. The filter includes a coil L51 in series with the capacitor C51, a transverse capacitor C55 and a serial coil L52, the other terminal of which is connected to the first feed point FP1. The filter is then of low-pass type. Also the radiation impedance between the feed point FP1 and the ground, which is resistive in the resonance, belongs functionally to the filter. If only the lower operating band of the antenna is utilized when the feed point FP1 is in use, the boundary frequency of the filter FLT can be arranged between the lower and upper operating band. In this case the antenna does not radiate significantly at the harmonic frequencies of the basic resonance frequency, which corresponds to the lower operating band, because the filter attenuates the possible harmonics. If both the lower and upper operating band are utilized, when the feed point FP1 is in use, the boundary frequency of the filter FLT can be arranged above the upper operating band. In this case the radiation is prevented at the harmonic frequencies above the upper operating band.

A filter like the one shown in FIG. 5 can naturally also be in the reactive circuits, which connect to other feed points. In addition, a high-pass filter can be used, if there is reason to attenuate the signals falling onto the lower operating band.

FIG. 6 shows a third example of the adjustable antenna according to the invention. There are now two feed points FP1 and FP2 in the radiating element 610, which are coupled to the outputs of the multi-way switch SW1 through the serial capacitors C61, C62, as in FIG. 3. Also a short-circuit point SP is in the radiating element, as in FIG. 3. In addition a grounding point GP is in it in this example, which point is coupled to the input of a second multi-way switch SW2 through the blocking capacitor C63. The second multi-way switch SW2 has here two outputs, one of which is connected directly to the ground and the other to the ground through a reactance X6. When the state of the second multi-way switch is changed, the impedance between the grounding point GP and ground changes, in which case also the electric lengths and resonance frequencies of the antenna change. Because both the feed point and the impedance between the grounding point GP and ground can be changed, both operating bands of the antenna in FIG. 6 have in principle four alternative places.

The number of the outputs of the second multi-way switch SW2 and corresponding alternative impedances can also be more than two. On the other hand, the use of the switchable grounding point is naturally not tied to the number of the feed points.

FIG. 7 shows a fourth example of the adjustable antenna according to the invention. There are now four feed points FP1, FP2, FP3 and FP4 in the radiating element 710, which are coupled to the outputs of the multi-way switch SW through the serial capacitors C71, C72, C73, C74, as in FIG. 3. Differently, the radiating element is not short-circuited to the ground from any point, for which reason the antenna in the example is of ILA type (Inverted L-Antenna).

FIG. 8 shows an example of the width and displacement of operation bands of an antenna according to the invention, when the adjusting circuit is controlled. The example relates to an antenna, which is in accordance with FIGS. 4*a*, 4*b*. In it the length l of the radiator support frame is 40 mm, the height h is 5 mm and the width w is 5 mm. Also the distance d from the radiator to the edge of the ground plane is 5 mm. The second C42, third C43 and fourth C44 capacitor are mere blocking capacitors, the capacitance of which is 100 pF. The first capacitor C41 is a tuning capacitor, the capacitance of which is 3 pF. The antenna is designed for different GSM systems, the frequency ranges W1-W4 used by them are marked in the figure:

W1=the frequency range 824-894 MHz used by US-GSM

W2=the frequency range 1710-1880 MHz used by GSM1800

W3=the frequency range 880-960 MHz used by EGSM (Extended GSM)

W4=the frequency range 1850-1990 MHz used by GSM1900

Curve 81 shows fluctuation of the reflection coefficient S11 as a function of frequency, when the feed conductor FC is connected to the first feed point FP1, curve 82 shows fluctuation of the reflection coefficient, when the feed conductor is connected to the second feed point FP2 and curve 83 shows fluctuation of the reflection coefficient, when the feed conductor is connected to the third feed point FP3. The first feed point FP1 is used, when the radio device functions in the US-GSM system. (In this case the upper operating band in the frequency 1.6-1.75 GHz remains unused.) It can be found from curve 81 that the above-mentioned frequency range W1 will be covered so that the reflection coefficient is −7 dB or better. The second feed point FP2 is used, when the radio device functions in the GSM1800 system. (In this case the lower operating band around the frequency 900 MHz remains unused.) It can be found from curve 82 that the above-mentioned frequency range W2 will be covered so that the reflection coefficient is −4.5 dB or better. The third feed point FP3 is used, when the radio device functions in the EGSM or GSM1900 system. It can be found from curve 83 that the above-mentioned frequency range W3 will be covered so that the reflection coefficient is −6 dB or better and the frequency range W4 so that the reflection coefficient is −5.5 dB or better.

When the first feed point FP1 is changed to the third feed point FP3, or vice versa, the lower operating band of the antenna shifts about 60 MHz. Such a displacement is implemented by the low capacitance of the first capacitor C41 and the tuning slot SL2, seen in FIG. 4*a*.

FIG. 9 shows an example of the efficiency of an antenna according to the invention. The efficiency has been measured in the same antenna as the reflection coefficient curves in FIG. 8, the antenna being in free space. Curve 91 shows the fluctuation of the efficiency as a function of frequency in the lower operating band, when the feed conductor FC is connected to the first feed point FP1, curve 92 shows fluctuation of the efficiency in the upper operating band, when the feed conductor is connected to the second feed point FP2 and curve 93 shows fluctuation of the efficiency in both operating bands, when the feed conductor is connected to the third feed point FP3. It can be seen from the curves that the efficiency in the above-mentioned frequency ranges W1, W2, W3 and W4 is about −3 dB on average.

The adjustable antenna according to the invention has been described above. Its structure can naturally differ in detail from that which is presented. The radiating element of the antenna can also be a quite rigid metal sheet, the feed points of which are connected by spring contacts. The spring can in this case be constituted of a bent projection of the radiator or it can be a threaded spring inside a so-called pogo pin. The radiating element can be located also e.g. on the surface of a ceramic substrate. The ground plane can also extend below the radiator. The capacitive elements of the reactive circuits can be implemented, instead discrete capacitors, also by short open or short-circuited planar transmission lines. The antenna can be a PIFA (Planar IFA) provided with several feed points. It can comprise also a parasitic element, by means of which one extra resonance and operating band are implemented.

It will be recognized that while certain aspects of the invention are described in terms of a specific sequence of steps of a method, these descriptions are only illustrative of the broader methods of the invention, and may be modified as required by the particular application. Certain steps may be rendered unnecessary or optional under certain circumstances. Additionally, certain steps or functionality may be added to the disclosed embodiments, or the order of performance of two or more steps permuted. All such variations are considered to be encompassed within the invention disclosed and claimed herein.

While the above detailed description has shown, described, and pointed out novel features of the invention as applied to various embodiments, it will be understood that various omissions, substitutions, and changes in the form and details of the device or process illustrated may be made by those skilled in the art without departing from the invention. The foregoing description is of the best mode presently contemplated of carrying out the invention. This description is in no way meant to be limiting, but rather should be taken as illustrative of the general principles of the invention. The scope of the invention should be determined with reference to the claims.

The invention claimed is:

1. A multiband antenna having at least a lower operating frequency band and an upper operating frequency band, the antenna comprising:

a dielectric element having a first dimension;

a conductive coating deposited on the dielectric element, the conductive coating having a first portion and a second portion, wherein said first and second portions are formed substantially parallel to each other along said first dimension;

a feed structure, comprising at least a first and a second feed points, said feed structure coupled to the conductive coating; and a nonconductive slot formed between the first and second portions along said first dimension;

wherein said slot is configured to form a quarter wave resonator in said upper operating band; and wherein said first and second portions cooperate to form a quarter wave resonator in said lower operating band.

2. The antenna of claim 1, wherein said first dimension comprises a substantially transverse dimension.

3. An antenna according to claim 1, wherein said radiating element further comprises a tuning slot disposed between said first and said second feed points.

4. An antenna according to claim 1, further comprising:
a signal ground;
at least first and second impedance circuits; and
a multi-way switch, comprising:
at least one input port; and
at least a first and a second output ports;
wherein said input port of said multi-way switch is coupled to said radiating element; and
wherein said at least first and second output ports of said multi-way switch are coupled to said signal ground via said least a first and a second impedance circuits, respectively.

5. An antenna according to claim 4, wherein said radiating element is short-circuited to said signal ground, thereby forming a in inverted-F antenna structure.

6. The antenna of claim 4, wherein said at least first and second impedance circuits comprise substantially different impedance.

7. An antenna according to claim 4, wherein said radiating element further comprises a tuning slot disposed between said first and said second feed points.

8. The antenna of claim 1, further comprising at least first and second reactive circuits;
wherein said first feed point is electrically coupled to a transceiver via said first reactive circuit; and
wherein said second feed point is electrically coupled to a transceiver via said second reactive circuit.

9. An antenna according to claim 8, wherein at least one of said at least first and second reactive circuits comprises a serial capacitor arranged to increase the electric length of said radiating element.

10. An antenna according to claim 8, wherein at least one of said at least first and second reactive circuits comprises a low-pass filter configured to substantially mitigate radiation at the harmonic frequencies of a resonance frequency corresponding to at least one operating band.

11. An antenna according to claim 8, wherein at least one of said at least first and second reactive circuits comprises a planar transmission line.

12. An antenna operable in at least a lower and an upper operating frequency bands, said antenna comprising:
a radiating element having at least first and second feed points, a ground point, and a short circuit point;
a selector circuit configured to select at least one of said at least lower and upper operating frequency bands, said selector circuit comprising:
a first multi-way switch, having at least one input port and at least first and second output ports; and
at least first and second reactive circuits;
wherein, said first and second feed points are coupled to said first and second output ports through said first and second reactive circuits, respectively.

13. A mobile radio device comprising an antenna operable in at least a lower and an upper operating frequency bands, a feed structure, and a signal ground, said antenna comprising:
a radiating element having at least first and second feed points, a ground point, and a short circuit point;
a selector circuit configured to select at least one of said at least lower and upper operating frequency bands, said selector circuit comprising:
a first multi-way switching element, having at least one input port and at least first and second output ports; and
at least first and second reactive circuits;
wherein, said first and second feed points are coupled to said first and second output ports through said first and second reactive circuits, respectively; and
wherein said at least one input port is configured to be coupled to said antenna through said feed structure.

14. An antenna according to claim 13, wherein said radiating element is electrically coupled to the mobile radio device only via said at least a first and a second feed points, thereby forming an inverted-L antenna structure.

15. A method of operating multi-band antenna, the antenna comprising a radiating element, and at least first and second feed points, the method comprising:
selectively electrically coupling said first feed point to a transceiver via a first of a plurality of reactive circuits; or
selectively electrically coupling said second feed point to a transceiver via a second of a plurality of reactive circuits;
wherein the first and second reactive circuits cause the antenna to operate in first and second frequency bands, respectively.

16. The method of claim 15, wherein the radiator element further comprises a first portion, a second portion, and a tuning circuit, and the method further comprises utilizing said tuning circuit to selectively alter at least one of the first and second frequency bands.

17. An adjustable antenna of a radio device, said radio device comprising an antenna port, said antenna comprising:
a signal ground;
a radiating element, comprising:
at least a first and a second feed points;
a ground point; and
a short circuit port;
a feed conductor; and
an adjusting circuit configured to effect at least one of said at least lower and upper operating frequency bands, said circuit comprising:
a first multi-way switch, comprising at least one input port and at least a first and a second output ports; and
at least first and second reactive circuits;
wherein, said first and second feed points are coupled to said first and second output ports through said first and second reactive circuits respectively; and
wherein said at least one input port is configured to be coupled to said antenna through said feed conductor.

18. An antenna according to claim 17, wherein said radiating element further comprises:
a first portion; and
a second portion, formed substantially parallel with said first portion; and
a nonconductive slot formed substantially between the first portion and the second portion;
wherein said nonconductive slot is sized so as to form a resonance in said upper operating frequency band; and
wherein said radiating element is configured to form a resonance in said lower operating frequency band.

19. An antenna according to claim 17, wherein at least one of said at least first and second reactive circuits comprises a serial capacitor arranged to increase the electric length of said radiating element.

20. An antenna according to claim 17, wherein at least one of said at least first and second reactive circuits comprises a low-pass filter configured to substantially mitigate radiation at the harmonic frequencies of a resonance frequency corresponding to at least one operating band.

21. An antenna according to claim 17, wherein at least one of said at least first and second reactive circuits comprises a planar transmission line.

22. An antenna according to claim 17, wherein said radiating element is electrically coupled to the radio device only via said at least a first and a second feed points, thereby forming an inverted-L antenna structure.

23. An antenna according to claim 17, wherein said multi-way switch is selected from the group consisting of:

a field-effect transistor (FET) switch;

a pseudomorphic high electron mobility transistor (PHEMT) switch; and microelectromechanical system (MEMS) switch.

24. An antenna according to claim 17, wherein said radiating element is short-circuited to said signal ground from said short-circuit port, thereby forming a in inverted-F antenna structure.

25. An antenna according to claim 24, further comprising:

at least a first and a second impedance circuits; and a second multi-way switch, comprising:

at least one input port; and at least a first and a second output ports; and wherein:

said input port of said second multi-way switch is coupled to said radiating element ground point;

said at least first and second impedance circuits comprise substantially different impedance; and said at least first and second output ports of said second multi-way switch are coupled to said signal ground via said least a first and a second impedance circuits.

26. An antenna according to claim 24, wherein said radiating element further comprises:

a tuning slot disposed between two adjacent feed points, and configured to increase the electric distance between the first and the second of said two adjacent feed points, thereby increasing the displacement of at least one of said at least a lower and an upper operating frequency bands.

* * * * *